US008210155B2

(12) United States Patent
Ohta et al.

(10) Patent No.: US 8,210,155 B2
(45) Date of Patent: Jul. 3, 2012

(54) METHOD OF AND DEVICE FOR CONTROLLING PRESSURE IN ACCUMULATION CHAMBER OF ACCUMULATION FUEL INJECTION APPARATUS

(75) Inventors: Yuji Ohta, Nagasaki (JP); Tomohide Yamada, Sagamihara (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 169 days.

(21) Appl. No.: 12/595,449

(22) PCT Filed: Oct. 9, 2008

(86) PCT No.: PCT/JP2008/068812

§ 371 (c)(1),
(2), (4) Date: Dec. 8, 2009

(87) PCT Pub. No.: WO2009/090782

PCT Pub. Date: Jul. 23, 2009

(65) Prior Publication Data

US 2010/0269790 A1 Oct. 28, 2010

(30) Foreign Application Priority Data

Jan. 18, 2008 (JP) ..... 2008-009549

(51) Int. Cl.
*F02M 57/02* (2006.01)
*F02M 63/00* (2006.01)

(52) U.S. Cl. ..... 123/446; 123/447

(58) Field of Classification Search ..... 123/446, 123/447, 495, 497, 467, 458
See application file for complete search history.

(56) References Cited

U.S. PATENT DOCUMENTS 5,237,975 A * 8/1993 Betki et al. ..... 123/497
5,289,812 A * 3/1994 Trombley et al. ..... 123/533
5,379,741 A * 1/1995 Matysiewicz et al. ..... 123/497
5,483,940 A * 1/1996 Namba et al. ..... 123/497
5,505,180 A * 4/1996 Otterman et al. ..... 123/497
5,579,738 A * 12/1996 Frischmuth et al. ..... 123/497
5,715,797 A * 2/1998 Minagawa et al. ..... 123/497
(Continued)

FOREIGN PATENT DOCUMENTS

JP 11-30150 2/1999
(Continued)

*Primary Examiner* — Thomas Moulis
(74) *Attorney, Agent, or Firm* — Birch, Stewart, Kolasch & Birch, LLP

(57) ABSTRACT

A method of and a device for controlling a pressure is provided in which control performance of accumulation chamber pressure is not deteriorated even in the presence of a disturbance by estimating, with observer control, a disturbance pressure that acts on an accumulation chamber (common rail) constituting an accumulator fuel injection apparatus adapted for use in a diesel engine and the like, and by correcting a pump discharge command with a compensation value capable of compensating for the estimated disturbance pressure.

Provision of a feedback control unit 42 capable of calculating a pump discharge command value of a fuel pump based on a pressure difference between an actual accumulation chamber pressure detected by a fuel pressure sensor 46 and a target pressure of an accumulation chamber and a disturbance observer control unit 44 capable of deriving a compensation value compensating the disturbance by the numerical model of the pump discharge command value to the fuel pump, the disturbance pressure acting on the accumulation chamber, and an accumulation chamber pressure by using a transfer function of the fuel pump and by estimating the disturbance pressure from the numerical model, and an output from the feedback control unit 42 is corrected with the disturbance compensation value from the disturbance observer control unit 44.

8 Claims, 5 Drawing Sheets

U.S. PATENT DOCUMENTS 5,749,344 A * 5/1998 Yoshiume et al. ..... 123/399
5,819,709 A * 10/1998 Holmes et al. ..... 123/497
6,135,090 A * 10/2000 Kawachi et al. ..... 123/446
6,142,121 A * 11/2000 Nishimura et al. ..... 123/456
6,170,459 B1 * 1/2001 Ono et al. ..... 123/305
6,223,731 B1 * 5/2001 Yoshiume et al. ..... 123/497
6,293,757 B1 * 9/2001 Oda et al. ..... 417/53
6,298,830 B1 * 10/2001 Kono ..... 123/478
6,539,921 B1 * 4/2003 Matsumura ..... 123/456
6,581,574 B1 * 6/2003 Moran et al. ..... 123/497
6,715,470 B2 * 4/2004 Takahashi ..... 123/458
6,840,222 B2 * 1/2005 Schilling et al. ..... 123/458
6,955,148 B2 * 10/2005 Rosenzopf et al. ..... 123/179.17
6,971,368 B2 * 12/2005 Uchiyama ..... 123/359
7,066,149 B1 * 6/2006 Date et al. ..... 123/457
7,188,022 B2 * 3/2007 Yasui et al. ..... 701/103
7,188,608 B2 * 3/2007 Wilson et al. ..... 123/456
7,246,005 B2 * 7/2007 Johnson ..... 701/111
7,287,515 B2 * 10/2007 Okamura et al. ..... 123/494
7,320,312 B2 * 1/2008 Takahashi ..... 123/446
7,392,793 B2 * 7/2008 Hayakawa ..... 123/479
7,418,337 B2 * 8/2008 Toyohara et al. ..... 701/104
7,431,020 B2 * 10/2008 Ramamurthy ..... 123/497
7,463,967 B2 * 12/2008 Ancimer et al. ..... 701/104
7,472,690 B2 * 1/2009 Takayanagi et al. ..... 123/446
7,474,952 B2 * 1/2009 Sugiyama ..... 701/104
7,487,760 B2 * 2/2009 Okayasu et al. ..... 123/495
7,509,944 B2 * 3/2009 Okamura ..... 123/478
7,779,814 B2 * 8/2010 Ishihara ..... 123/446
7,950,371 B2 * 5/2011 Cinpinski et al. ..... 123/446
7,980,120 B2 * 7/2011 Cinpinski et al. ..... 73/114.43

FOREIGN PATENT DOCUMENTS

JP 2003-106208 A 4/2003
JP 2005-76618 A 3/2005
JP 2005-301764 A 10/2005
JP 2007-92655 A 4/2007
JP 3944143 B2 4/2007
JP 2007-113481 A 5/2007

* cited by examiner

METHOD OF AND DEVICE FOR CONTROLLING PRESSURE IN ACCUMULATION CHAMBER OF ACCUMULATION FUEL INJECTION APPARATUS

TECHNICAL FIELD

The present invention relates to a pressure control method and a pressure control device in an accumulation chamber (a common rail) adapted for use in constituting an accumulator fuel injection apparatus employed for a diesel engine and the like.

BACKGROUND ART

An accumulator (a common rail type) fuel injection apparatus is constructed to implement pumping of fuel under a pressure to a common accumulation chamber by means of a high pressure fuel feed pump driven by an engine and to allow a fuel injection nozzle of each cylinder to be connected to the accumulation chamber, so as to inject the high pressure fuel stored in the accumulation chamber to each cylinder of an internal combustion engine.

The fuel injection amount to each cylinder is uniquely determined by a pressure prevailing in the accumulation chamber, i.e., an accumulation chamber pressure, and an electric conduction time for which electricity to the fuel injection nozzles (injectors) provided for the respective cylinders lasts.

Accordingly, accurate control of the accumulation chamber pressure enables to achieve highly precise fuel injection control.

In general, fuel pumping control from a fuel feed pump to an accumulation chamber often has, as shown in FIG. 7, both a feedback control unit 01 and a feedforward control unit 02, and a feedforward amount is obtained in the feedforward control unit 02 from maps for each combination with a target pressure, a command value of fuel injection amount, and a number of engine revolutions.

Then, an output of the feedback control unit 01 and an output of the feedforward control unit 02 are added together and a pump discharge command value, for example an amount of plunger stroke as a pump discharge command value when a pump 03 is comprised of a plunger pump, is commanded to drive the pump 03 so as to feed the fuel to a common rail 04, and thus the pressure in the common rail 04 is controlled so as to be maintained at determined target pressure.

The maps used in the above-mentioned feedforward control unit 02 are often obtained by experiment in advance. Another technique also may be applied to obtain a feedforward amount from inverse characteristics of a formulation model of pump and common rail.

For example, techniques disclosed in Patent Document 1 (Japanese Laid-Open Patent Application No. 2005-76618) and Patent Document 2 (Japanese Laid-Open Patent Application No. 2005-301764) are known regarding pressure control in a common rail.

In this Patent Document 1, a technique of using both feedforward control and feedback control is disclosed, in which pressure in the common rail is equalized by repeating a procedure of, in correspondence with the crank angle of an engine, detecting fuel pressure in the common rail to calculate a difference from predetermined target fuel pressure, outputting a part of the pressure difference as a feedforward amount, applying feedback control to the rest, and adding the feedforward amount to an output of the feedback.

In addition, Patent Document 2 creates a dynamic model for a common rail system and calculates a control amount in association with a target fuel pressure based on the model to thereby execute the feedforward control.

Nevertheless, since a feedforward amount is determined by a combination of a target pressure, a command value of fuel injection amount, and a number of engine revolutions in the feedforward control unit 02 shown in FIG. 7, if a disturbance is developed that acts as an unexpected control variable other than the target pressure, the fuel injection amount, and a fluctuation in the number of engine revolutions, such a disturbance cannot be controlled for the reason that the disturbance is out of coverage for control. Therefore, the control performance must be deteriorated. Moreover, in case of creating multidimensional maps including control variables other than the target pressure, the command value of fuel injection amount, and the number of engine revolutions, there occurs a problem of increasing the number of test cases and thus requiring enormous amount of labor and efforts.

In addition, although the technique of Patent Document 1 complements a response delay of feedback control complemented with feedforward control using both the feedforward control unit 02 and the feedback control unit 01, such control is insufficient in a case that any unexpected disturbance is developed, and furthermore, the technique disclosed in Patent Document 2 does not exhibit sufficient control performance when a disturbance other than the conditions for creating the dynamic model of common rail system is developed.

DISCLOSURE OF THE INVENTION

The present invention was, therefore, made in light of the described background, and the problem to be solved by the invention is to provide a pressure control method and a pressure control device that do not deteriorate control performance of accumulation chamber pressure even in the presence of any disturbance by estimating a disturbance pressure acting on an accumulation chamber (a common rail) which constitutes an accumulator fuel injection apparatus applied to a diesel engine and the like with observer control, and by correcting a pump discharge command with a compensation value compensating for the estimated disturbance pressure.

In order to solve the above-described problems, a first aspect of the present invention provides a method of controlling an accumulation chamber pressure in an accumulator fuel injection apparatus, which includes an accumulation chamber for storing fuel under pressure, a fuel injection nozzle for injecting the fuel in the accumulation chamber into an internal combustion engine, and a fuel pump for pumping the fuel under pressure to the accumulation chamber, an accumulator fuel injection apparatus controlling a pump discharge amount of the fuel pump to bring a fuel pressure prevailing in the accumulation chamber to a target pressure, wherein the method comprises the steps of: calculating a pump discharge command value of the fuel pump by using feedback, based on a pressure difference between an actual accumulation chamber pressure detected by a fuel pressure sensor and the target pressure of the accumulation chamber; producing a numerical model of the pump discharge command value of the fuel pump, a disturbance pressure acting on the accumulation chamber, and an accumulation chamber pressure by using a transfer function of the fuel pump; estimating a pressure of the disturbance from the numerical model; deriving a compensation value to compensate for the disturbance by using a disturbance observer; and correcting an output calculated by the feedback with the disturbance compensation value derived by the disturbance observer.

In addition, a second aspect of the present invention provides a device for controlling accumulation chamber pressure in an accumulator fuel injection apparatus including: an accumulation chamber for storing a pressurized fuel; a fuel injection nozzle for injecting the fuel in the accumulation chamber into an internal combustion engine; a fuel pump for pumping the fuel under pressure to the accumulation chamber; and control means for controlling a pump discharge amount of the fuel pump so as to bring a fuel pressure prevailing in the accumulation chamber to a target pressure, wherein the control means comprises: a feedback control unit configured to calculate a pump discharge command value of the fuel pump by using feedback, based on a pressure difference between an actual accumulation chamber pressure detected by a fuel pressure sensor and a target pressure in the accumulation chamber; and a disturbance observer control unit configured to generate a numerical model of the pump discharge command value of the fuel pump, a disturbance pressure acting on the accumulation chamber, and an accumulation chamber pressure by using a transfer function of the fuel pump, to estimate a disturbance pressure from the numerical model, and to derive a compensation value capable of compensating for the disturbance, and wherein an output from the feedback control unit is corrected with a disturbance compensation value from the disturbance observer control unit.

In accordance with the controlling method of the first aspect of the present invention and the controlling device of the second aspect of the present invention, application of the disturbance observer controlling enables to produce the numerical model of the discharge command value of the fuel pump, the disturbance pressure acting on the accumulation chamber, and the accumulation chamber pressure by using the transfer function of the fuel pump, to estimate the disturbance pressure from the numerical model, and to derive the compensation value that is capable of compensating the disturbance to thereby correct the output value of the feedback controlling with the compensation value. Therefore, compensation performance against the disturbance is more improved than the prior art in which the control is conducted by using the feedback control together with the feedforward control.

That is to say, since the disturbance per se is derived from the numerical model for estimation, control accuracy against the disturbance is more improved in comparison with a conventional case where the disturbance is preliminarily set in a map as conditions.

Further, a lot of time and labor to be used for creating multidimensional maps by adding disturbance conditions are not needed and thus, the controlling of the pressure prevailing in the accumulation chamber can be achieved by extremely simple means.

Moreover, in the first aspect of the present invention, the internal combustion engine is preferably comprised of a diesel engine, and an output from the feedforward control unit that calculates the pump discharge command value preliminarily set, based on the target pressure, the number of engine revolutions, and the command value of fuel injection amount is preferably added further to the feedback output. In addition, in the second aspect of the present invention, it is preferred that an internal combustion engine is comprised of a diesel engine, and the device further comprises a feedforward control unit that calculates a pump discharge command value preliminarily set, based on the target pressure, the number of engine revolutions, and the command value of fuel injection amount, and an output from the feedforward control unit is preferably added to the feedback output.

In accordance with the configuration of the control method of the first aspect of the present invention and the control device of the second aspect of the present invention, since a high responsivity in the feedforward control is added, a high responsivity due to the feedforward control is ensured and in addition, because of the fact that the disturbance compensation is effected by the disturbance observer control, the control performance is furthermore improved.

Moreover, in the first aspect of the present invention, the disturbance observer preferably blocks an output of the disturbance compensation value if the derived disturbance compensation value exceeds a given chosen range, and in the second aspect of the present invention, the disturbance observer control unit preferably includes a limiter capable of blocking an output of the disturbance compensation value if the derived disturbance compensation value exceeds a given range.

In accordance with such configurations of the first and second aspects of the present invention, when the disturbance compensation value exceeds a given chosen range, blocking of the output of the disturbance compensation value is performed so as to prohibit the disturbance observer control to be executed, whereby control is carried out only with either only the feedback control or both the feedback control and the feedforward control.

Thus, it will be understood from the foregoing that since the accumulation chamber and the fuel pump can be protected by providing the output of the disturbance observer with such a limitation that divergence of the observer control output may be avoided even if any extraordinarily large disturbance is developed, reliability of compensation function exhibited by the disturbance observer control is improved.

It should here be noted that blocking of the output, in a case that an output of the disturbance observer exceeding the limitation lasts for a certain period of time in sequence, can prevent occurrence of stopping of the control due to any transient disturbance.

In accordance with the present invention, it is possible to provide a method of and a device for controlling a pressure in an accumulation pressure chamber that constitutes an accumulator fuel injection apparatus applied to a diesel engine and the like, which method and device estimate, with observer control, a disturbance pressure that acts on the accumulation chamber (common rail) constituting the accumulator fuel injection apparatus, and correct a pump discharge command with a compensation value compensating for the estimated disturbance pressure and therefore, control performance in the controlling of accumulation chamber pressure cannot be deteriorated even in the presence of the disturbance.

BEST MODE FOR CARRYING OUT THE INVENTION

Preferred embodiments of the present invention will now be described more in detail by exemplification with reference to the accompanying drawings. It is intended, however, that unless particularly specified, dimensions, materials, forms, relative positions and so forth of the constituent parts and elements in the embodiments will be interpreted as illustrative only not as limitative of the scope of the present invention.

(First Embodiment)

The first embodiment of the present invention is described with reference to FIGS. 1 through 3.

Figure 1:
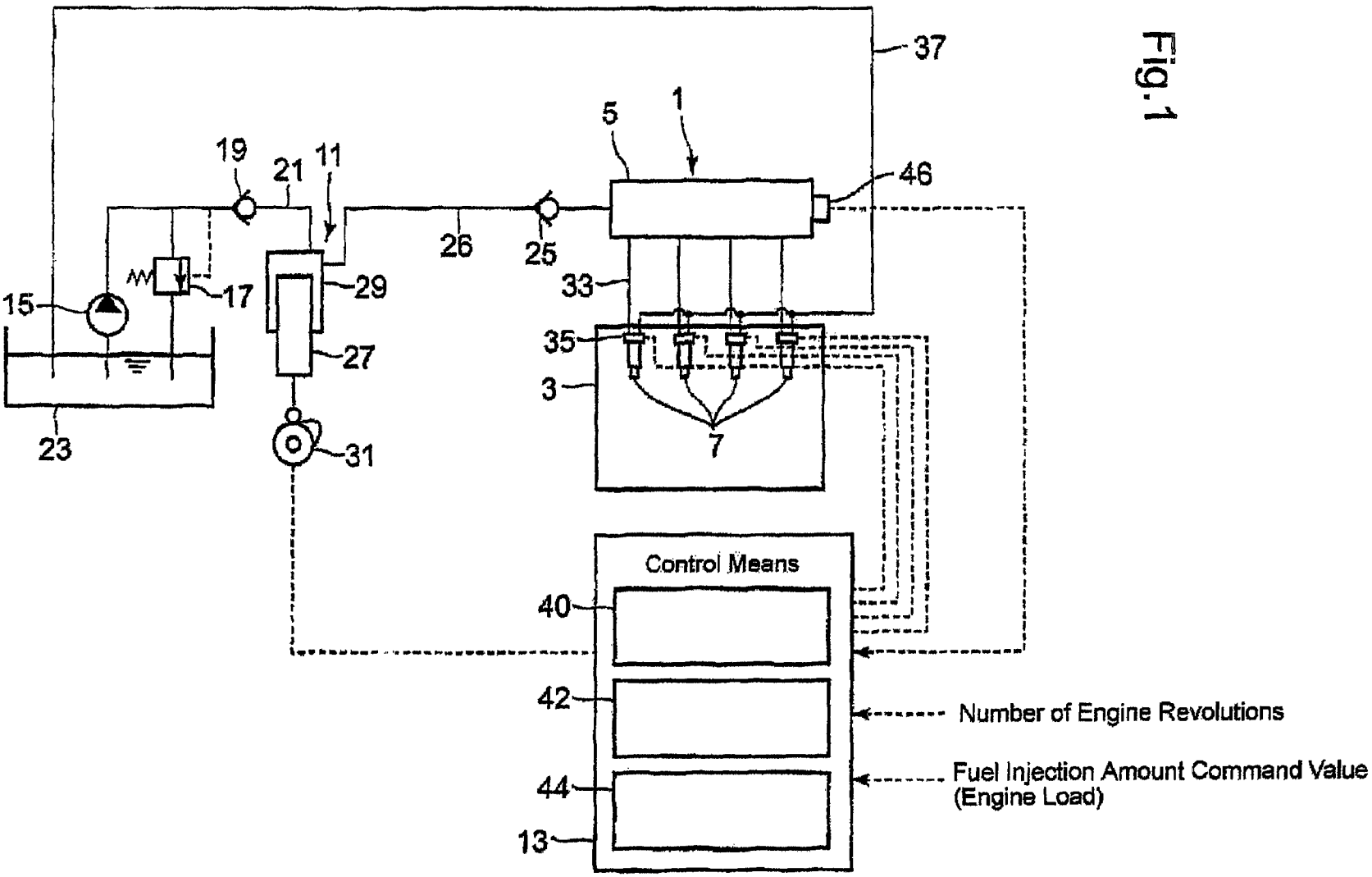
FIG. 1 is an overall schematic view of an accumulator fuel injection apparatus, according to the present invention, applied to a diesel engine.

FIG. 1 is an overall schematic view of an accumulator fuel injection apparatus 1 according to an embodiment of the present invention, applied to a diesel engine 3. The accumulator fuel injection apparatus 1 is provided with a common rail (accumulation chamber) 5 for storing pressurized fuel, fuel injection nozzles 7 for injecting the fuel in the common rail 5 into the inside of combustion chambers of the diesel engine 3, a high pressure fuel pump (fuel pump) 11 for pumping and feeding the fuel under pressure to the common rail 5, and control means 13 which controls a pump discharge amount of the high pressure fuel pump 11 so as to determine the fuel pressure in the common rail 5 as a target pressure.

Further, the fuel is fed to the high pressure fuel pump 11 from a fuel tank 23 via a fuel feed pump 15, a relief valve 17, a check valve 19, and a fuel feed pipe 21, and the high pressure fuel is fed to the common rail 5 from the high pressure fuel pump 11, via a check valve 25, and a communicating pipe 26.

When the fuel feed pump 15 feeds the fuel under a pressure higher than a determined pressure, the relief valve 17 releases a part of the fuel pressure by releasing the fuel from the fuel feed pipe 21 to the fuel tank 23. In addition, while a plunger 27 of the high pressure fuel pump 11 rises, the check valve 19 blocks the fuel feed pipe 21 to prevent a backflow. The check valve 25 also prevents high pressure fuel from flowing back from the accumulation chamber 5 to the high pressure fuel pump 11.

The high pressure fuel pump 11 is shown, for example, in the form of a plunger type. The fuel is pressurized by vertical reciprocation of the plunger 27, in a plunger chamber 29, by a cam 31 driven by the diesel engine 3. Then, by controlling an effective stroke of the plunger 27, such as modifying the cam profile, with signals from the control means 13 described later, the fuel discharge amount fed to the common rail 5 is controlled, and thus the fuel pressure in the common rail 5 is controlled at a constant pressure.

The high pressure fuel from the common rail 5 is fed to the fuel injection nozzles 7 of each cylinder via feed pipelines 33, and is controlled in injection timing and injection amount of fuel to each cylinder by controlling opening and closing of electromagnetic valves 35 provided with the fuel injection nozzles 7 of each cylinder. In addition, from the fuel injection nozzles 7, the fuel left uninjected is returned to the fuel tank 23 through a fuel return pipe 37.

In the accumulator fuel injection apparatus 1 constituted as described above, the control means 13 is provided with a feedforward control unit 40, a feedback control unit 42, and a disturbance observer control unit 44.

Then, a signal from a fuel pressure sensor 46 detecting an actual pressure of the common rail 5 is inputted to the control means 13 and thus, the actual pressure, a number of engine revolutions, a command value of a target fuel injection amount (engine load) are inputted, respectively.

In the feedback control unit 42, an amount of feedback control is calculated by PID control based on a pressure difference between target pressure of the common rail 5 predetermined by the operational conditions of the engine (number of revolutions, loads) and an actual pressure of the common rail 5 detected by the fuel pressure sensor 46, and thus a pump discharge command value is calculated.

Figure 2:
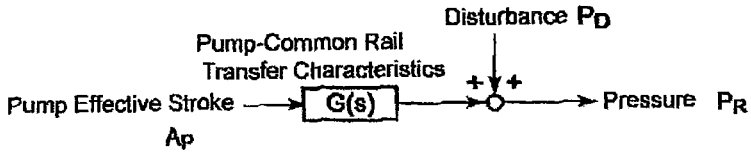
FIG. 2 is an illustration of system overview for numerical modeling by disturbance observer control.

In addition, in the disturbance observer control unit 44, a formulation model of the system shown in FIG. 2 is created to predict disturbance.

FIG. 2 shows a system indicating output pressure when disturbance pressure ($P_D$) affects after passing through transfer characteristics (G(s)) of pump and common rail system using an effective stroke ($A_P$) of the high pressure fuel pump as an input, that is using a pump discharge amount as an input. It should be noted that the transfer characteristics (G(s)) of the pump and common rail system is a transfer function of a pump, and is a function expressing corelationship of the pressure in the common rail relative to the effective stroke of the plunger pump.

The system of FIG. 2 is formulated as Expression (1), below.

$$P_R = G(s)A_P + P_D \tag{1}$$

$P_R$: Pressure of Common Rail $P_D$: Disturbance Pressure $A_P$: Pump Effective Stroke Accordingly, disturbance pressure $P_D$ can be estimated by Expression (2), below.

$$P_D = P_R - G(s)A_P \tag{2}$$

To estimate the disturbance pressure, the pump effective stroke and the pressure of the common rail have to be detected. Although the pressure of the common rail is detectable with the sensor, the pump effective stroke is difficult to be detected, and therefore, given is pump effective stroke $A_P \approx$command value of pump effective stroke $A_R$, a disturbance pressure estimated value $\hat{P}_D$ is derived by Expression (3).

$$\hat{P}_D = P_R - G(s)A_R \tag{3}$$

The disturbance pressure can be compensated for by changing the pump effective stroke. Accordingly, the disturbance pressure estimated value is converted into a pump effective stroke compensation value $A_H$.

The conversion is carried out by utilizing an inverse function $G_P^{-1}(s)$ of a linear pump transfer function $G_P(s)$ as Expression (4).

$$A_H = G_P^{-1}(s)\hat{P}_D = G_P^{-1}(s)P_R - A_R \tag{4}$$

If there is a differential term in the inverse function $G_P^{-1}(s)$, a noise signal in a common rail pressure signal is also differentiated to eventually cause any vibration in the common rail. Observer bandwidth $\omega_D$ is thus introduced, and the result of executing the filtering equation is represented as Expression (5).

$$A' = (G_P^{-1}(s)P_R - A_R)\frac{\omega_D}{S + \omega_D} \tag{5}$$

Based on the pump effective stroke compensation value A' processed with a bandwidth derived as above, an output from the feedback control unit 42 (FIG. 3) is corrected.

Figure 3:
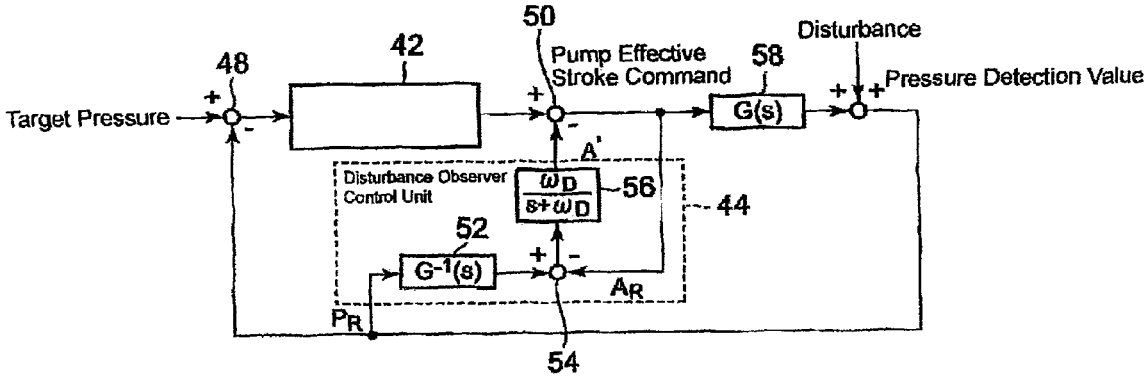
FIG. 3 is a block diagram of control logic for the first embodiment.

As shown in the block diagram of control logic in FIG. 3, a target common rail pressure predetermined from operational conditions and an actual value of common rail pressure detected by the fuel pressure sensor 46 are inputted via a subtractor 48 to the feedback control unit 42, and then relative to the pump effective stroke (pump discharge command value) of the output value from the feedback control unit 42, the above-described pump effective stroke compensation value A' processed with a bandwidth, which is an output value of the disturbance observer control unit 44, is inputted to a subtractor 50 to correct the output value of the feedback control unit 42.

In this disturbance observer control unit 44, actual common rail pressure $P_R$, including disturbance pressure acting on the common rail 5, that is pressure fluctuation within the common rail 5 due to fuel injection from the fuel injection nozzles 7 to respective cylinders, pressure fluctuation based on mechanical vibrations due to injection by the fuel injection nozzles 7, etc., is inputted from the fuel pressure sensor 46.

Then, an inverse function unit 52 of a pump transfer function is multiplied, and the command value $A_R$ of pump effective stroke is subtracted from the result in an adder/subtractor 54, and then a filtering unit 56 of a vibration frequency bandwidth of the bandwidth $\omega_D$ is multiplied with the result to obtain the pump effective stroke compensation value A' based on Expression (5) in which the high frequency components for noise is removed.

Then, the output from the feedback control unit 42 is corrected in the subtractor 50, and the command value of pump effective stroke after correction is inputted to the transfer characteristics unit 58 of the pump and common rail system.

In practice, the discharge amount is controlled by a command indicating the plunger stroke of the high pressure fuel pump 11.

According to the first embodiment described above, by estimating disturbance pressure in the disturbance observer control unit 44 from a command value of pump effective stroke and actual common rail pressure and by deriving a pump effective stroke compensation value that compensates the disturbance pressure to zero, the output from the feedback control unit 42 is corrected to calculate the command value of pump effective stroke, so that the compensation performance against disturbance is more improved than the control using both feedback control and feedforward control according to the prior art.

In other words, since a disturbance per se is derived from a numerical model for estimation, control accuracy for the disturbance is more improved in comparison with a case where a disturbance is preliminarily set in a map as one of conditions.

Further, a lot of time and a lot of labor and efforts that are needed for creating multidimensional maps by adding disturbance conditions are not required, and the pressure in the accumulation chamber can be controlled by the extremely simple means.

(Second Embodiment)

Figure 4:
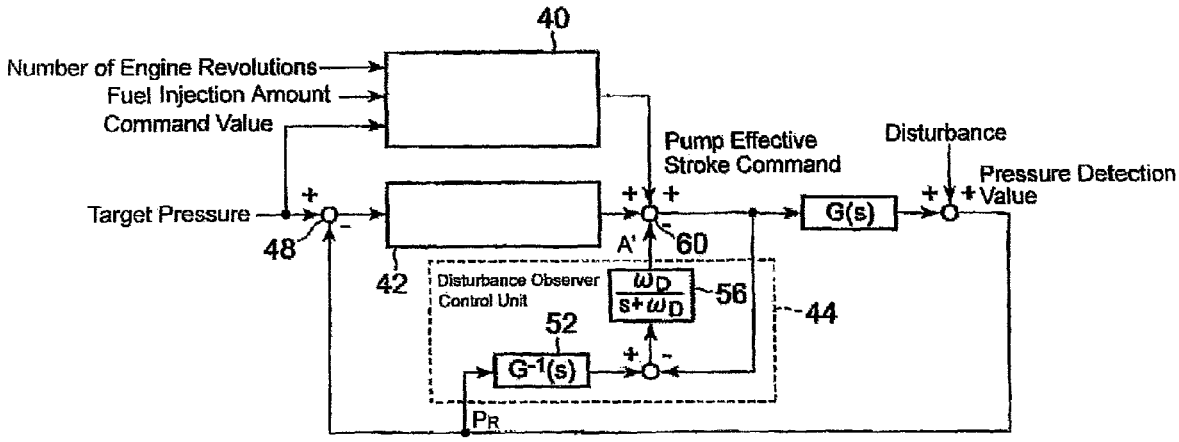
FIG. 4 is a block diagram of control logic for the second embodiment.

Next, with reference to FIG. 4, the second embodiment is described hereinbelow.

In the second embodiment, a feedforward control unit 40 is further added to the first embodiment. Target common rail pressure is set that is predetermined by engine operational conditions, which are a number of engine revolutions and a command value of target fuel injection amount (engine load), inputted to the control means 13, and a command value of a pump effective stroke pre-mapped based on the experiments conducted is preliminarily calculated in this feedforward control unit 40, based on the number of engine revolutions, the command value of target fuel injection amount, and a target accumulation chamber pressure.

Then, the command value of the pump effective stroke calculated in this feedforward control unit 40 is added to a command value from the feedback control unit 42 in an adder/subtractor 60, and the pump effective stroke compensation value A' derived in the disturbance observer control unit 44 as described in the first embodiment is subtracted for correction, and thus a command value of the pump effective stroke is calculated.

Accordingly, a high responsivity due to the feedforward control unit 40 is secured by adding the high responsivity of the feedforward control unit 40, and an entire control performance is furthermore improved by the disturbance compensation executed by the disturbance observer control unit 44.

(Third Embodiment)

Figure 5:
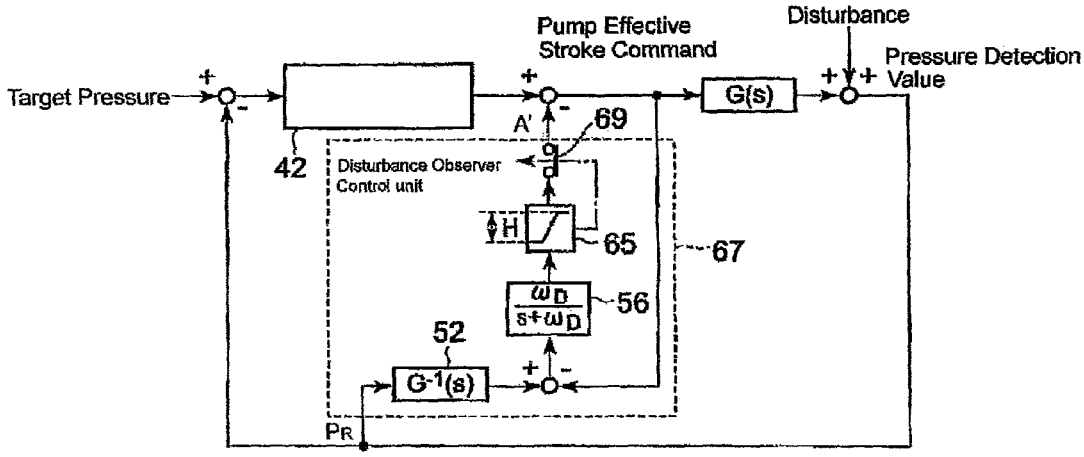
FIG. 5 is a block diagram of control logic for the third embodiment.

Next, with reference to FIG. 5, the third embodiment is described.

In the third embodiment, a limiter 65 is provided to the first embodiment in a disturbance observer control unit 67 to avoid any divergence of the disturbance observer control. The other construction and arrangement are similar to the first embodiment.

As shown in FIG. 5, in a case that a pump effective stroke compensation value A' outputted from the disturbance observer control unit 44 exceeds a given range H, the limiter 65 is operated to turn off a switch 69 provided with an output line and to block the output from the disturbance observer control unit 67.

Since the common rail 5 and the high pressure fuel pump 11 can be protected by providing such limitation for the disturbance observer output and avoiding the divergence of the observer control output when extraordinarily large disturbance is developed, reliability of the pump effective stroke compensation value A' by the disturbance observer control unit 44 is improved.

It should be noted that blocking the output, in a case that an output exceeding the limitation is continued for a certain period of time in sequence, can prevent stopping control due to the transiently developed disturbance, and thus the reliability of the disturbance observer control unit 44 can be even further improved.

(Fourth Embodiment)

Figure 6:
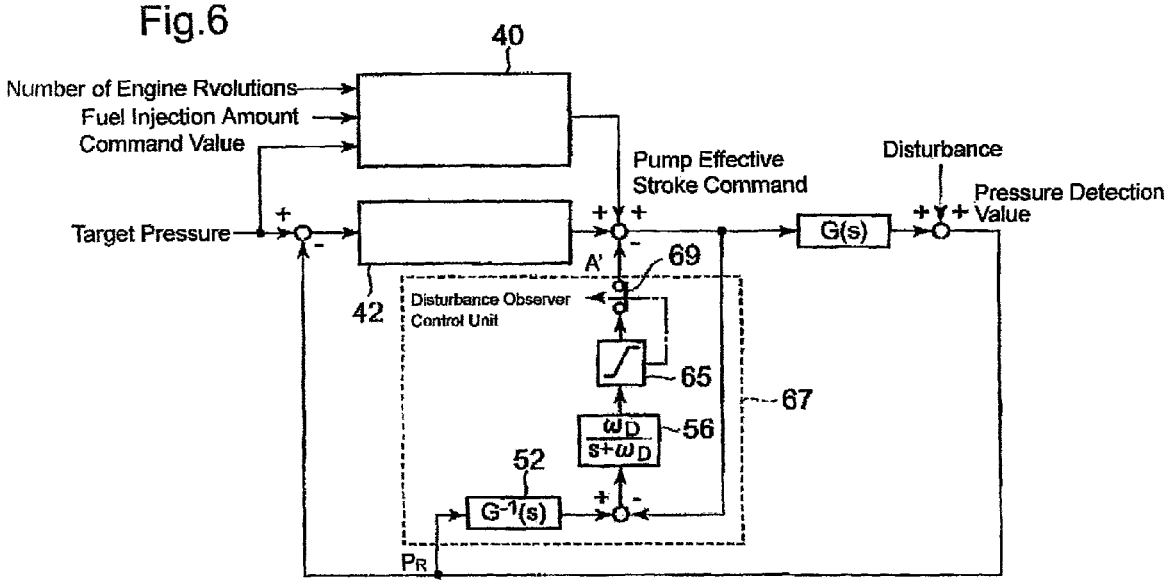
FIG. 6 is a block diagram of control logic for the fourth embodiment.
Figure 7:
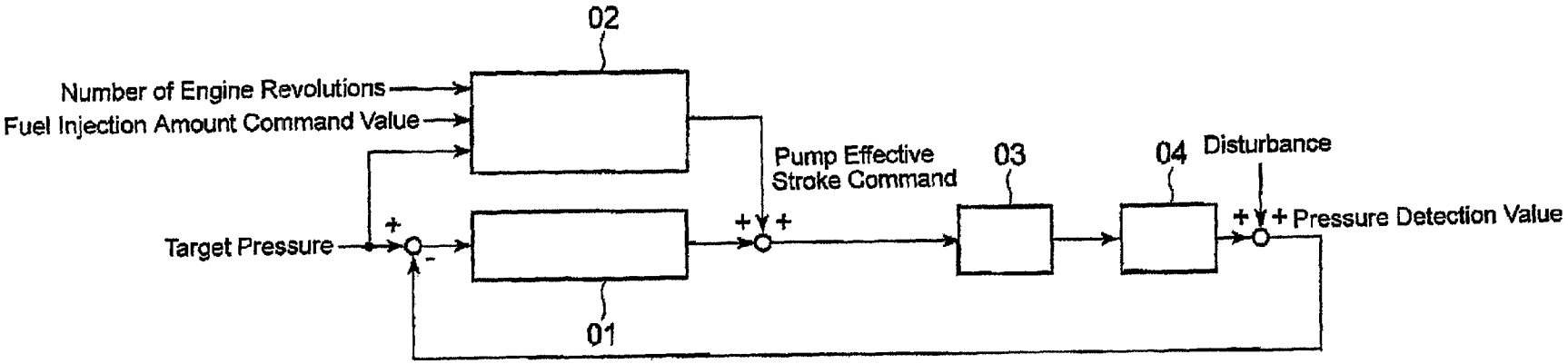
FIG. 7 is a block diagram of control logic for illustrating the prior art.

Next, with reference to FIG. 6, the fourth embodiment is described.

The fourth embodiment has a configuration such that both the described second and third embodiments are incorporated therein, and as shown in FIG. 6, the control construction is added with a feedforward control unit 40 and is provided with a limiter 65 for disturbance observer control.

According to such fourth embodiment, high responsivity due to the feedforward control unit 40 is secured, and the operational reliability of the disturbance observer control unit 44 is improved by including the limiter 65, and thus, both reliability and control performance for the disturbance pressure are more improved.

Industrial Applicability

According to the present invention, since deterioration in control performance of accumulation chamber pressure can be prevented even in the presence of any disturbance by estimating a disturbance pressure, with observer control, acting on the accumulation chamber (common rail) constituting the accumulator fuel injection apparatus applied to a diesel engine and the like, and by correcting the pump discharge command with a compensation value compensating the estimated disturbance pressure, the present invention is useful for application to a method of controlling accumulation chamber pressure of accumulator fuel injection apparatus, such as a diesel engine and the like, and a pressure control device.

The invention claimed is:

1. A method of controlling an accumulation chamber pressure in an accumulator fuel injection apparatus, which comprises an accumulation chamber for storing a fuel under pressure, a fuel injection nozzle for injecting the fuel in the accumulation chamber into an internal combustion engine, and a fuel pump for pumping the fuel to the accumulation chamber, an accumulator fuel injection apparatus controlling a pump discharge amount of the fuel pump to bring a fuel pressure prevailing in the accumulation chamber to a target pressure, wherein the method comprises the steps of:

calculating a pump discharge command value of the fuel pump by using feedback, based on a pressure difference between an actual accumulation chamber pressure detected by a fuel pressure sensor and the target pressure of the accumulation chamber;

producing a numerical model of the pump discharge command value of the fuel pump, a disturbance pressure acting on the accumulation chamber, and accumulation chamber pressure using a transfer function of the fuel pump;

estimating a pressure of the disturbance from the numerical model;

deriving a compensation value to compensate for the disturbance by using a disturbance observer; and correcting an output calculated by the feedback with the disturbance compensation value derived by the disturbance observer.

2. A method of controlling an accumulation chamber pressure in an accumulator fuel injection apparatus according to claim 1, wherein the internal combustion engine is comprised of a diesel engine, and wherein an output from a feedforward control unit calculating a pump discharge command value preliminarily set, based on the target pressure, a number of engine revolutions, and a command value of the fuel injection amount is further added to the output calculated by the feedback.

3. A method of controlling an accumulation chamber pressure of an accumulator fuel injection apparatus according to claim 1 wherein the disturbance observer blocks an output of the disturbance compensation value when the derived disturbance compensation value exceeds a given range.

4. A device for controlling an accumulation chamber pressure in an accumulator fuel injection apparatus, which includes an accumulation chamber for storing a fuel under pressure;

a fuel injection nozzle for injecting the fuel in the accumulation chamber into an internal combustion engine; a fuel pump for pumping the fuel to the accumulation chamber; and control means for controlling a pump discharge amount of the fuel pump to bring a fuel pressure prevailing in the accumulation chamber to a target pressure, wherein the control means comprises: a feedback control unit configured to calculate a pump discharge command value of the fuel pump by using feedback, based on a pressure difference between an actual accumulation chamber pressure detected by a fuel pressure sensor and a target pressure in the accumulation chamber; and a disturbance observer control unit configured to generate a numerical model of the pump discharge command value of the fuel pump, a disturbance pressure acting on the accumulation chamber, and an accumulation chamber pressure by using a transfer function of the fuel pump, to estimate a disturbance pressure from the numerical model, and to derive a compensation value capable of compensating for the disturbance, and wherein an output from the feedback control unit is corrected with the compensation value of the disturbance, which comes from the disturbance observer control unit.

5. A device for controlling an accumulation chamber pressure in an accumulator fuel injection apparatus, according to claim 4, wherein an internal combustion engine is comprised of a diesel engine, and the device further comprises a feedforward control unit configured to calculate a pump discharge command value preliminarily set, based on the target pressure, a number of engine revolutions, and a command value of fuel injection amount, and an output from the feedforward unit is added to the output of the feedback unit.

6. A device for controlling an accumulation chamber pressure in an accumulator fuel injection apparatus, according to claim 4 wherein the disturbance observer control unit comprises a limiter configured to block an output of the disturbance compensation value when the derived disturbance compensation value exceeds a given range.

7. A method of controlling an accumulation chamber pressure of an accumulator fuel injection apparatus according to claim 2 wherein the disturbance observer blocks an output of the disturbance compensation value when the derived disturbance compensation value exceeds a given range.

8. A device for controlling an accumulation chamber pressure in an accumulator fuel injection apparatus, according to claim 5 wherein the disturbance observer control unit comprises a limiter configured to block an output of the disturbance compensation value when the derived disturbance compensation value exceeds a given range.

* * * * *